US011053604B2

(12) United States Patent
Arvin et al.

(10) Patent No.: US 11,053,604 B2
(45) Date of Patent: Jul. 6, 2021

(54) SYSTEM FOR TREATING SOLUTION FOR USE IN ELECTROPLATING APPLICATION AND METHOD FOR TREATING SOLUTION FOR USE IN ELECTROPLATING APPLICATION

(71) Applicant: International Business Machines Corporation, Armonk, NY (US)

(72) Inventors: Charles L. Arvin, Savannah, GA (US); Glen N. Biggs, Wappingers Falls, NY (US); Phillip W. Palmatier, Hopewell Junction, NY (US); Joseph C. Sorbello, Wappingers Falls, NY (US); Tracy A. Tong, Wallkill, NY (US); Freddie Torres, Beacon, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 16/521,084

(22) Filed: Jul. 24, 2019

(65) Prior Publication Data

US 2019/0345627 A1 Nov. 14, 2019

Related U.S. Application Data

(62) Division of application No. 14/524,677, filed on Oct. 27, 2014, now Pat. No. 10,450,667.

(51) Int. Cl.
*C25D 21/18* (2006.01)
*C25D 3/30* (2006.01)
(Continued)

(52) U.S. Cl.
CPC ..... *C25D 21/18* (2013.01); *C25D 21/06* (2013.01); *C25D 21/14* (2013.01); *C25D 3/30* (2013.01); *C25D 3/38* (2013.01)

(58) Field of Classification Search
CPC .... C25D 21/18; C25D 3/38; C25D 7/12–123; C25D 17/001
See application file for complete search history.

(56) References Cited

U.S. PATENT DOCUMENTS 3,652,229 A * 3/1972 Burke ..... C01G 3/02 422/200
5,409,593 A 4/1995 Moskowitz
(Continued)

FOREIGN PATENT DOCUMENTS

DE 102009034390 A1 2/2011
FR 2986977 A1 8/2013
(Continued)

OTHER PUBLICATIONS

Kimizuka et al., Machine Translation, JP 2004-143478 A (Year: 2004).*
(Continued)

*Primary Examiner* — Brian W Cohen
*Assistant Examiner* — Ho-Sung Chung
(74) *Attorney, Agent, or Firm* — Scully, Scott, Murphy & Presser, P.C.; Steven J. Meyers

(57) ABSTRACT

Electroplating techniques including a system for treating a solution for use in an electroplating application and a method for using the system are provided. The system can have: a gas dispersing portion configured to treat the solution by dispersing a gas into the solution to control a concentration of a predetermined cation of a metal to be electroplated in the electroplating application; a filter portion configured to treat the solution by filtering the solution to remove a quantity of metal residue; and a circulation mechanism configured to divert the solution to one of a plating tool and a combination of the gas dispersing portion and the filter portion based on a result of an analysis of the solution.

15 Claims, 2 Drawing Sheets

1

(51) Int. Cl.

| | |
|---|---|
| ***C25D 3/38*** | (2006.01) |
| ***C25D 21/06*** | (2006.01) |
| ***C25D 21/14*** | (2006.01) |

(56) References Cited

U.S. PATENT DOCUMENTS

| | | | | |
|---|---|---|---|---|
| 6,527,920 | B1 | 3/2003 | Mayer et al. | |
| 7,727,863 | B1 | 6/2010 | Buckalew et al. | |
| 7,754,140 | B2 | 7/2010 | Rajner | |
| 8,795,480 | B2 | 8/2014 | Mayer | |
| 2002/0033340 | A1* | 3/2002 | Cheung | C23C 18/1617 205/101 |
| 2004/0187731 | A1 | 9/2004 | Wang et al. | |
| 2006/0054508 | A1 | 3/2006 | Lin et al. | |
| 2011/0056840 | A1* | 3/2011 | Isono | C25D 21/04 205/296 |
| 2013/0168256 | A1 | 7/2013 | Lackner et al. | |
| 2013/0284604 | A1 | 10/2013 | Spurlin | |
| 2014/0166476 | A1 | 6/2014 | Abraham et al. | |

FOREIGN PATENT DOCUMENTS

| | | | | |
|---|---|---|---|---|
| JP | 2004143478 | A | * | 5/2004 |
| JP | 2004143478 | A | | 5/2004 |
| JP | 2007000694 | A | | 1/2007 |
| JP | 2009051723 | A | | 3/2009 |
| JP | 2010084195 | A | | 4/2010 |
| JP | 5066025 | B2 | | 11/2012 |
| JP | 2013028850 | A | | 2/2013 |
| WO | 9417224 | A1 | | 8/1994 |
| WO | 2006111837 | A2 | | 10/2006 |
| WO | 2007008591 | A2 | | 1/2007 |
| WO | 2007078787 | A1 | | 7/2007 |

OTHER PUBLICATIONS

Kimizuka et al., Partial Human Translation, JP 2004-143478 A (Year: 2004).*

Office Action dated Jan. 30, 2018 received in related U.S. Appl. No. 14/524,677.

Office Action dated Dec. 26, 2018 received in related U.S. Appl. No. 14/524,677.

Office Action dated Sep. 22, 2017 received in related U.S. Appl. No. 14/524,677.

Notice of Allowance dated Sep. 22, 2017 received in related U.S. Appl. No. 14/524,677.

List of IBM Patents or Patent Applications Treated As Related, dated Jul. 24, 2019, 2 pages.

* cited by examiner

SYSTEM FOR TREATING SOLUTION FOR USE IN ELECTROPLATING APPLICATION AND METHOD FOR TREATING SOLUTION FOR USE IN ELECTROPLATING APPLICATION

BACKGROUND

The present disclosure relates generally to a system for treating a solution for use in an electroplating application and a method for treating a solution for use in an electroplating application. More particularly, the present disclosure relates to techniques for treating or maintaining an electroplating solution for use in an electroplating tool and techniques for treating or pre-treating a metal concentrate solution for use in an electroplating tool.

Generally, an electroplating tool is configured to deposit a layer of a metal as a plating material on top of a workpiece that is a different metal to modify one or more surface properties of the workpiece. The workpiece is placed in an electroplating tank containing an electroplating solution. An electrical circuit is created when a negative terminal of a power supply is connected to the workpiece so as to form a cathode and a positive terminal of the power supply is connected to another metal in the electroplating tank so as to form an anode. Electroplating material, typically a stabilized metal ion, is provided in the electroplating solution. During the electroplating process this metal ion is replenished with a soluble metal that forms the anode and/or can be added, directly to the electroplating solution (e.g., as a metal salt). When an electrical current is passed through the circuit, metal ions in the electroplating solution take-up electrons at the workpiece and a layer of metal is formed on the workpiece.

Electroplating solutions can contain organic additives. Different kinds of organic additives are used in electroplating solutions. A first kind or organic additive is referred to as a "brightener". A brightener makes a plating film dense and improves its luster. An example of a brightener is mercaptoalylsulfonic acid ($HS—C_nH_{2n}—SO_3$). This substance exists as an anion in, for example, a copper sulfate plating solution, and prevents the precipitation of a copper ion and promotes its fine division. A second kind of organic additive is referred to as a "suppressor". A suppressor is adsorbed to a cathode surface and suppresses the precipitation of a metal ion to enhance activation polarization and raise uniform electrodensity. A third kind of organic additive is referred to as a "leveler". A leveler is an organic compound containing nitrogen or oxygen that tends to decrease electroplating rate. An example of a leveler additive is a polyamine. In electroplating systems, the concentration of organic additives must be closely controlled in the low parts per million range in order to attain desired deposition properties and morphology.

SUMMARY

According to an embodiment of the present invention, a system for treating a solution for use in an electroplating application is provided. The system comprises: a gas dispersing portion configured to treat the solution by dispersing a gas into the solution to control a concentration of a predetermined cation of a metal to be electroplated in the electroplating application; a filter portion configured to treat the solution by filtering the solution to remove a quantity of metal residue; and a circulation mechanism configured to divert the solution to one of a plating tool and a combination of the gas dispersing portion and the filter portion based on a result of an analysis of the solution.

According to another embodiment of the present invention, a method for treating a solution for use in an electroplating application. The method comprises: operating a gas dispersing portion to treat the solution by dispersing a gas into the solution to control a concentration of a predetermined cation of a metal to be electroplated in the electroplating application; operating a filter to treat the solution by filtering the solution to remove a quantity of the metal residue; and operating a circulation mechanism to divert the solution to one of a plating tool and a combination of the gas dispersing portion and the filter portion based on a result of an analysis of the solution.

BRIEF DESCRIPTION OF THE DRAWINGS

The following detailed description, given by way of example and not intended to limit the invention solely thereto, will best be appreciated in conjunction with the accompanying drawings, wherein like reference numerals denote like elements and parts, in which.

DETAILED DESCRIPTION

Figure 1:
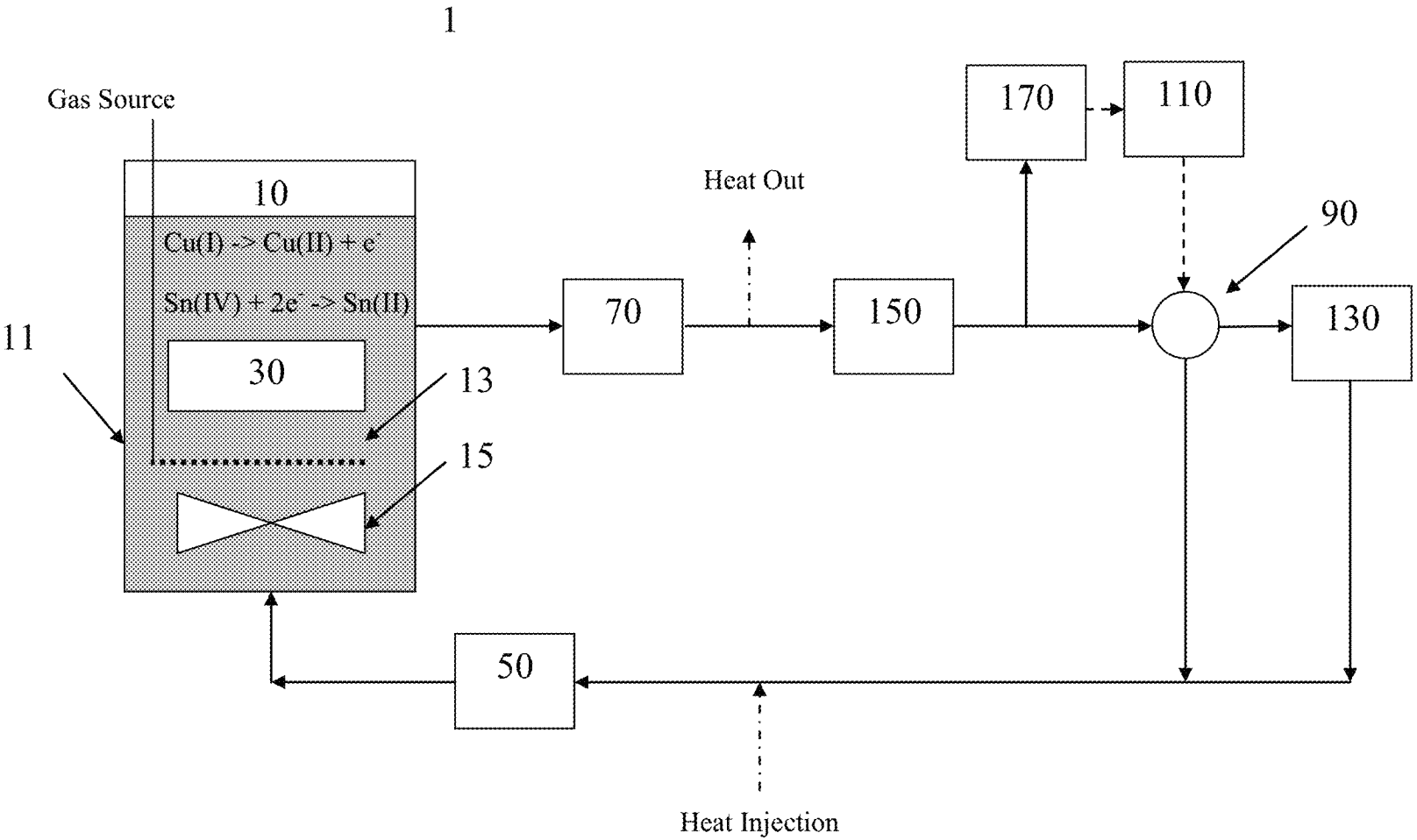
FIG. 1 is a block diagram showing a system for treating an electroplating solution according to a first embodiment of the invention.

Detailed embodiments of the present invention are disclosed herein; however, it is to be understood that the disclosed embodiments are merely illustrative of the invention that may be embodied in various forms. In addition, each of the examples given in connection with the various embodiments of the invention is intended to be illustrative, and not restrictive. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

Damascene processing is a technique for forming copper integrated circuit interconnects. A through-silicon-via (TSV) is a vertical electrical connection passing through a silicon wafer. TSVs are used to create 3D packages and 3D integrated circuits. Conductive routes on an integrated circuit formed during Damascence processing and TSVs can be filled with copper using copper electroplating techniques (including a system, apparatus and a process).

A copper plating solution for use in copper electroplating techniques can include an electrolyte of a copper salt such as copper sulfate ($CuSO_4$), an acid to increase the conductivity of the plating solution, and one or more organic additives.

Buildup of cuprous cations Cu(I) in the copper plating solution can significantly impact the performance of the copper plating solution. Although not wishing to be limited to one or more particular theories, it is thought that Cu(I) may interact with one or more organic additives to change copper deposition characteristics and defects. Interaction with one or more organics additives may lead to breakdown of the one or more organic additives that increases cost related to replacing the organic additives. Further, it is thought that Cu(I) itself in the copper plating solution may lead to changes in plating overpotential and current density to alter fill rate and plating performance. Therefore, in copper electroplating techniques, control of Cu(I) concentration in the copper plating solution is desired for improving plating performance and improving operational cost. Similar concerns exist for controlling Cu(I) concentration in copper concentrate used in the preparation of copper plating solutions.

Tin and tin alloy (tin/lead, tin/antimony, tin/bismuth, and the like) deposition using tin electroplating techniques can be useful in the manufacture of electronic components such as printed circuit boards, electrical contacts and connectors, semiconductors, and electrical conduits.

A tin plating solution for use in tin electroplating techniques can include divalent tin Sn(II), acids such as methane sulfonic acid, and one or more organic additives.

Buildup of tetravelent tin Sn(IV) due to oxidation of Sn(II) in the tin plating solution can significantly impact the performance of the tin plating solution. Buildup of Sn(IV) results in a corresponding reduction in the amount of Sn(II) available for deposition. Further, Sn(IV) tends to precipitate as Sn(IV) oxide thereby forming an insoluble sludge that may cause equipment damage and increase operational cost. Therefore, in tin electroplating techniques, control of Sn(IV) concentration in the tin plating solution is desired for improving plating performance and improving operation cost. Similar concerns exist for controlling Sn(IV) concentration in tin concentrate used in the preparation of tin plating solutions.

In a first embodiment of the present invention, a system 1 for treating an electroplating solution is provided. The system 1, as illustrated in FIG. 1, can include a gas dispersing portion 10, a mesh portion 30, a filter portion 50, a carbon treatment portion 70, and a circulation mechanism 90. The system 1 can further include a controller 110 for controlling one or more of the gas dispersing portion 10, the mesh portion 30, the filter portion 50, the carbon treatment portion 70, and the circulation mechanism 90. The structures and functions of each component of the system 1 will be described in further detail below.

The system 1 can treat (or maintain) an electroplating solution such as a copper electroplating solution or a tin electroplating solution circulated from an electroplating tool 130.

The system 1 can further include the electroplating tool 130. The electroplating tool 130 can include an electrochemical plating cell, an electroless plating cell, or other plating cell configurations known in the art. The electroplating tool 130 can further be configured to have one or more membranes to separate and form an analyte chamber and a catholyte chamber.

The electroplating solution can be transferred by the circulation mechanism 90 from the electroplating tool 130 to the filter portion 50. The filter portion 50 includes one or more filters suitable for filtering, for example, a tin electroplating solution to remove a quantity of insoluble Sn(IV) oxide.

Next, the electroplating solution can be transferred by the circulation mechanism 90 from the filter portion 50 to the gas dispersing portion 10. The gas dispersing portion 10 can include a reservoir 11, a gas dispersing device 13, and an agitator 15. The reservoir 11 can be formed to have an inlet through which the electroplating solution is received and an outlet through which the electroplating solution that has been treated is removed by the circulating mechanism 90. The gas dispersing device 13 is configured to distribute a gas into the electroplating solution to treat the electroplating solution. The gas dispersing device 13 can include or be connected to a gas source, and can further include a disperser and one or more appropriate conduits, valves and/or pumps for dispersing the gas from the gas source into the electroplating solution through the disperser. The disperser can include one or more of a sparger, a fritted glass disk, a porous ceramic disk, or the like fitted to the one or more conduits to disperse the gas as fine bubbles to saturate the electroplating solution with the gas. The agitator 15 is configured to provide sufficient mixing of the electroplating solution within the reservoir 11 and distribution of the bubbles throughout the volume of the electroplating solution being treated in the reservoir 11. The reservoir 11 can also include one or more baffles to further provide sufficient mixing of the electroplating solution.

The gas dispersing portion 10 can further include a heat injector for heating the electroplating solution in advance of transfer of the electroplating solution into the reservoir 11 or for heating the electroplating solution in the reservoir 11 to ensure that dissolution of the gas dispersed by the disperser in the electroplating solution is to saturation. Further, the gas dispersing portion 10 can further include a heat extractor for extracting heat from the electroplating solution after treatment with the gas.

In the treatment of a copper electroplating solution, oxygen, oxygen diluted with an inert gas, or another appropriate gas can be selected as the gas provided by the gas source and dispersed by the disperser into the copper electroplating solution held in the reservoir 11. Although not wishing to be limited to one or more particular theories, it is thought that oxygen introduction prevents the formation of Cu(I) or oxidizes Cu(I) to Cu(II) to thereby control the concentration of Cu(I) in the copper electroplating solution. The reservoir 11 can further provide an inlet that is connected to appropriate conduits, valves, and pumps for introducing a liquid oxidizing agent such as hydrogen peroxide into the reservoir 11 to increase oxidation of Cu(I) to Cu(II).

In the treatment of a tin electroplating solution, an inert gas such as nitrogen gas can be selected as the gas provided by the gas source and dispersed by the disperser into the tin electroplating solution held in the reservoir 11. Although not wishing to be limited to one or more particular theories, it is thought that the nitrogen displaces gaseous oxygen that is ordinarily dissolved or dispersed in the tin electroplating solution to prevent the oxidation of Sn(II) to Sn(IV) to thereby control or suppress the formation of Sn(IV).

Next, the electroplating solution can be transferred by the circulation mechanism 90 from the gas dispersing portion 10 to the mesh portion 30. The mesh portion 30 can include a reservoir for holding the electroplating solution and a source of unoxidized tin having a high specific surface area. Structural forms of unoxidized tin can include one or more of a mesh, a foam, and a sponge. The electroplating solution is passed through the surface area of the tin mesh whereby Sn(IV) reacts with the unoxidized tin to form (and recover) Sn(II).

In a modification, the above-described gas dispersing portion 10 and the mesh portion 30 can be integrated in a single reservoir. For example, the tin mesh and the gas dispersing device 13 can be arranged in the reservoir 11. The gas dispersing device 13 disperses nitrogen gas through the tin electroplating solution to prevent the oxidation of Sn(II) to Sn(IV), and the tin electroplating solution is further passed through the tin mesh whereby Sn(IV) in the tin electroplating solution reacts with the unoxidized tin of the tin mesh to form and recover Sn(II).

Next, the electroplating solution can be transferred by the circulation mechanism 90 from the mesh portion 30 to the carbon treatment portion 70. The carbon treatment portion 70 can include one or more carbon treatment devices known to one of skill in the art, the one or more carbon treatment devices being configured to treat the electroplating solution to remove a quantity of organic additives from the electroplating solution.

The system 1 can further include a degassing portion 150. The degassing portion 150 is arranged to receive the electroplating solution that was treated by one or more of the gas dispersing portion 10, the mesh portion 30, the filter portion 50 and the carbon treatment portion 70 prior to circulation of the electroplating solution back to the electroplating tool 130, and configured to degas the electroplating solution to remove excess gas bubbles in the electroplating solution. The degassing portion 150 can include one or more of a fine filter-like membrane and a vacuum chamber configured to remove excess gas bubbles in the electroplating solution. Removal of excess gas bubbles in the electroplating solution may be desirable for reasons such as: avoiding plating defects on the workpiece due to gas bubbles blocking regions of the workpiece from being plated (whereby the blocked regions result in plating pit defects); and preventing gas bubbles from adhering to and damaging the one or more membranes in the electroplating tool 130.

Next, the electroplating solution or a sample of the electroplating solution can be transferred by the circulation mechanism 90 from the degassing portion 150 to an analysis system 170. The analysis system 170 can include one or more analysis devices known to one of skill in the art, the one or more analysis devices being configured to analyze one or more aspects of the electroplating solution. Aspects of the electroplating solution analyzed by the one or more analysis devices include concentrations of one or more desired metal ions, concentrations of one or more undesired metal ions, pH, concentrations of one or more organic additives, and concentrations of one or more products of the breakdown of organics additives.

In the first embodiment, the circulation mechanism 90 can include appropriate arrangements of conduits, valves, pumps, and the like that can be controlled manually or controlled by the controller 110 to transfer the electroplating solution from the electroplating tool 130 to one or more of the above-described components of the system 1, the analysis system 170 and back to the electroplating tool 130.

In the above-provided description of the first embodiment, the circulation mechanism 90 transports the electroplating solution sequentially through the filter portion 50, the gas dispersing portion 10, the mesh portion 30, the carbon treatment portion 70, the degassing portion 150, and the analysis system 170. The circulation mechanism 90 is not limited to such a sequential transfer of the electroplating solution. The circulation mechanism 90 can also be configured to transfer the electroplating solution through one or more of the filter portion 50, the gas dispersing portion 10, the mesh portion 30, the carbon treatment portion 70, the degassing portion 150, and the analysis system 170 in other orders.

The circulation mechanism 90 can be controlled to divert the electroplating solution to one of the electroplating tool 130 or one or more of the gas dispersing portion 10, the mesh portion 30, the filter portion 50, the carbon treatment portion 70 and the degassing portion 150, based on the results of the one or more analysis performed by the analysis system 170. In one example, when the one or more analysis performed by the analysis system 170 indicates a satisfactory result (e.g., a satisfactory concentration of a desired metal ion), the circulation mechanism 90 can be controlled by the controller 110 to divert the electroplating solution to the electroplating tool 130. In another example, when the one or more analysis performed by the analysis system 170 indicates an unsatisfactory result (e.g., an unsatisfactory concentration of a desired metal ion), the circulation mechanism 90 can be controlled by the controller 110 to divert the electroplating solution to one or more of the gas dispersing portion 10, the mesh portion 30, the filter portion 50, the carbon treatment portion 70, and the degassing portion 150 for repeated treatment.

The controller 110 can be implemented by hardware or a combination of hardware and software. The controller 19 can be embodied in, for example circuits, a central processing unit (CPU) executing instruction code, and a microprocessor.

In the first embodiment, the components of the system 1 can be organized as parts of an electroplating apparatus that can be arranged to the analysis system 110. In the first embodiment, the components of the system 1 can alternatively be organized as parts of an analysis apparatus that can be arranged to the electroplating tool 130.

Figure 2:
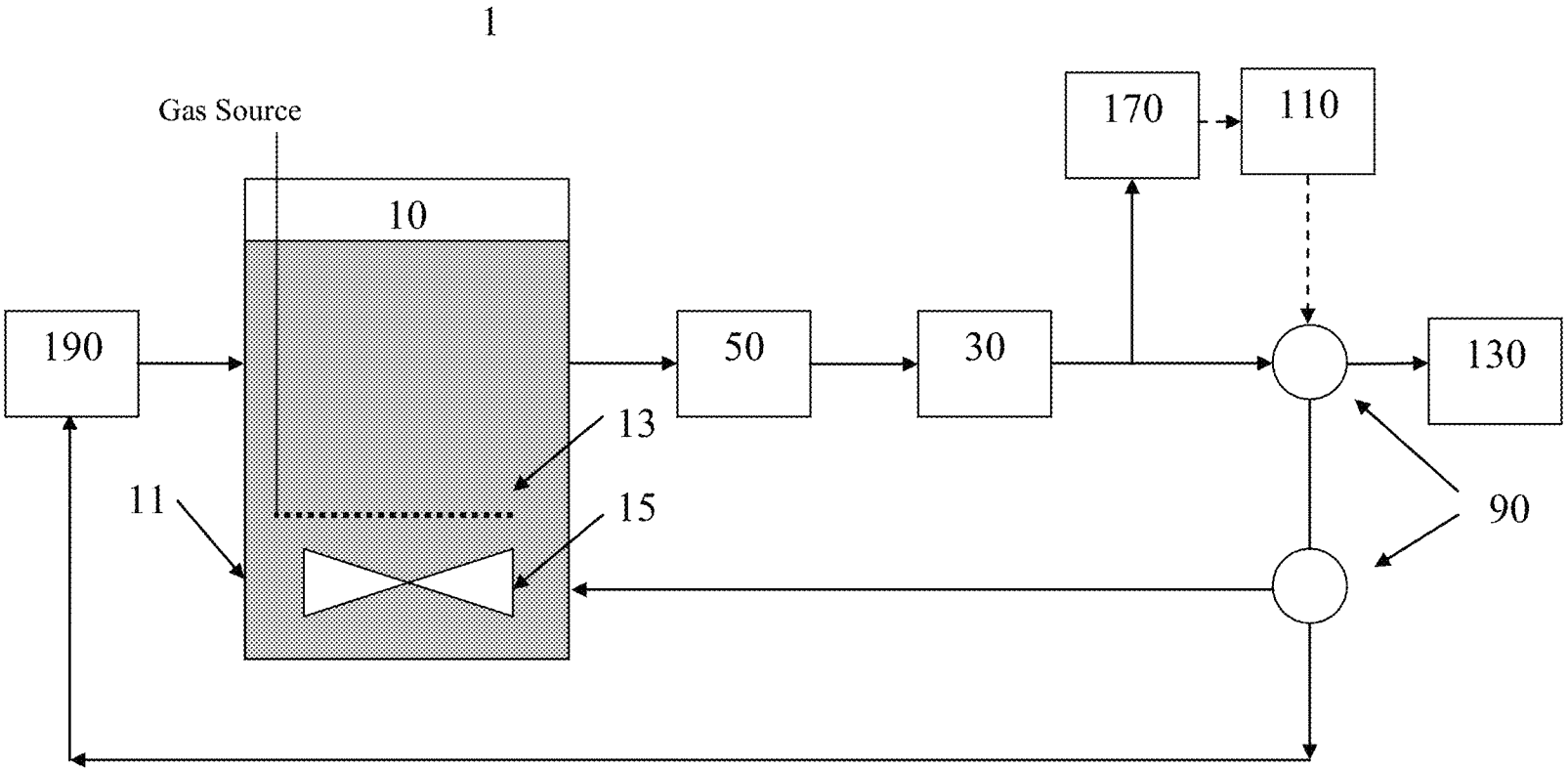
FIG. 2 is a block diagram showing a system for treating a metal concentrate for use in an electroplating application according to a second embodiment of the invention.

In a second embodiment of the present invention, a modification of the system 1 described in the first embodiment is provided. As illustrated in FIG. 2, the system 1 according to the second embodiment can include the above-described components of the system 1 according to the first embodiment.

The system 1 can treat (or pre-treat) a metal concentrate such as a copper concentrate and a tin concentrate that is then used to formulate a copper electroplating solution and a tin electroplating solution, respectively.

The system 1 can further include a metal concentrate reservoir 190 for receiving and holding a metal concentrate such as the tin concentrate and the copper concentrate.

The metal concentrate can be transferred by the circulation mechanism 90 from the metal concentrate reservoir 190 to the gas dispersing portion 10. The gas dispersing portion 10 in the second embodiment is configured to have similar structures and functions as described in the first embodiment.

In the treatment of the copper concentrate, oxygen, oxygen diluted with an inert gas, or another appropriate gas can be selected as the gas provided by the gas source and dispersed by the disperser into the copper concentrate held in the reservoir 11. It is thought that oxygen introduction prevents the formation of Cu(I) or oxidizes Cu(I) to Cu(II) to thereby control the concentration of Cu(I) in the copper concentrate.

In the treatment of the tin electroplating solution, an inert gas such as nitrogen gas can be selected as the gas provided by the gas source and dispersed by the disperser into the tin concentrate held in the reservoir 11. It is thought that the nitrogen displaces gaseous oxygen that is ordinarily dissolved or dispersed in the tin concentrate to prevent the oxidation of Sn(II) to Sn(IV) to thereby control or suppress the formation of Sn(IV).

Next, the metal concentrate can be transferred by the circulation mechanism 90 from the gas dispersing portion 10 to the filter portion 50. The filter portion 50 in the second embodiment is configured to have similar structures and functions as described in the first embodiment. The filter portion 50 can include one or more filters suitable for filtering, for example, the tin concentrate to remove a quantity of insoluble Sn(IV) oxide.

Next, the metal concentrate can be transferred by the circulation mechanism 90 from the filter portion 50 to the mesh portion 30. The mesh portion 30 in the second embodiment is configured to have similar structures and functions as described in the first embodiment. The tin concentrate is passed through the surface area of the tin mesh whereby Sn(IV) reacts with the unoxidized tin to form (and recover) Sn(II).

Next, the metal concentrate or a sample of the metal concentrate can be transferred by the circulation mechanism 90 from the mesh portion 30 to the analysis system 170 for analyzing one or more aspects of the metal concentrate. Aspects of the metal concentrate analyzed by the one or more analysis devices of the analysis system 170 include concentrations of one or more desired metal ions, concentration of one or more undesired metal ions, and pH.

In the second embodiment, the circulation mechanism 90 can include appropriate arrangements of one or more conduits, valves, pumps and the like that can be controlled manually or controlled by the controller 110 to transfer the metal concentrate from the metal concentrate reservoir 190 to one or more of the above-described components of the system 1, the analysis system 170 and back to the metal concentrate reservoir 190.

In the above-provided description of the second embodiment, the circulation mechanism 90 transports the metal concentrate sequentially through the gas dispersing portion 10, the filter portion 50, the mesh portion 30, and the analysis system 170. The circulation mechanism 90 is not limited to such a sequential transfer of the metal concentrate. The circulation mechanism 90 can also be configured to transfer the metal concentrate through one or more of the gas dispersing portion 10, the filter portion 50, the mesh portion 30, and the analysis system 170 in other orders.

The circulation mechanism 90 can be controlled to divert the electroplating solution to one of the electroplating tool 130 or one or more of the metal concentrate reservoir 190, the gas dispersing portion 10, the filter portion 50, and the mesh portion 30, based on the results of the one or more analysis performed by the analysis system 170. In one example, when one or more analysis performed by the analysis system 170 indicates a satisfactory result (e.g., a satisfactory concentration of a desired metal ion), the circulation mechanism 90 can be controlled by the controller 110 to divert the metal concentrate to the electroplating tool 130 to applied in the formulation of the electroplating solution. In another example, when one or more analysis performed by the analysis system 170 indicates a satisfactory result, the circulation mechanism 90 can be controlled by the controller 110 to divert the metal concentrate back to the metal concentrate reservoir 190 for storage. In another example, when the one or more analysis performed by the analysis system 170 indicates an unsatisfactory result (e.g., an unsatisfactory concentration of a desired metal ion), the circulation mechanism 90 can be controlled by the controller 110 to divert the metal concentrate to one or more of the gas dispersing portion 10, the filter portion 50, and the mesh portion 30 for repeated treatment.

In a third embodiment of the present invention, a method for using the system 1 described in the first embodiment is provided.

In the method, the circulation mechanism 90 is manually controlled or controlled by the controller 110 to transfer the electroplating solution from the electroplating tool 130 to the filter portion 50. Then, the filter portion 50 is operated to filter, for example, a tin electroplating solution comprising the electroplating solution to remove a quantity of insoluble Sn(IV) oxide.

Next, the circulation mechanism is manually controlled or controlled by the controller 110 to transfer the electroplating solution from the filter portion 50 to the gas dispersing portion 10. Then, the gas dispersing portion 10 is operated manually or through a control by the controller 110 to disperse a gas into the electroplating solution. In one example, the gas dispersing portion 10 is operated to disperse oxygen into a copper electroplating solution to prevent the formation of Cu(I) or oxidize Cu(I) to Cu(II) to thereby control the concentration of Cu(I) in the copper electroplating solution. In another example, the gas dispersing portion 10 is operated to disperse an inert gas such as nitrogen into a tin electroplating solution to displace gaseous oxygen in the tin electroplating solution to prevent the oxidation of Sn(II) to SN(IV) to thereby control or suppress the formation of Sn(IV).

Next, the circulation mechanism 90 is manually controlled or controlled by the controller 110 to transfer the electroplating solution from the gas dispersing portion 10 to the mesh portion 30. In an example of treating a tin electroplating solution, the mesh portion 30 is operated to pass the tin electroplating solution through the surface area of unoxidized tin in the form of a mesh whereby Sn(IV) reacts with the unoxidized tin to form (and recover) Sn(II).

Next, the circulation mechanism 90 is manually controlled or controlled by the controller 110 to transfer the electroplating solution from the mesh portion 30 to the carbon treatment portion 70. Then the carbon treatment portion 70 is operated to remove a quantity of organic additives from the electroplating solution.

Next, the circulation mechanism 90 is manually controlled or controlled by the controller 110 to transfer the electroplating solution from the carbon treatment portion 70 to the degassing portion 150. Then the degassing portion 150 is operated to remove excess gas bubbles in the electroplating solution.

Next, the circulation mechanism 90 is manually controlled or controlled by the controller 110 to transfer the electroplating solution or a sample of the electroplating solution to the analysis system 170. Then the analysis system 170 is operated to analyze the one or more aspects of the electroplating solution.

Next, the circulation mechanism 90 is manually controlled or controlled by the controller 110 to divert the electroplating solution to one of the electroplating tool 130 or to one or more of the gas dispersing portion 10, the mesh portion 30, the filter portion 50, the carbon treatment portion 70, and the degassing portion 150, based on the results of the one or more analysis performed by the analysis system 170. In one example, when the one or more analysis performed by the analysis system 170 indicates a satisfactory result, the circulation mechanism 90 is manually controlled or controlled by the controller 110 to divert the electroplating solution to the electroplating tool 130. In another example, when the one or more analysis performed by the analysis system 170 indicates an unsatisfactory result, the circulation mechanism 90 can be manually controlled or controlled by the controller 110 to divert the electroplating solution to one or more of the gas dispersing portion 10, the mesh portion 30, the filter portion 50, the carbon treatment portion 70, and the degassing portion 150 for repeated treatment.

In a fourth embodiment of the present invention, a method for using the system 1 described in the second embodiment is provided.

In the method, the circulation mechanism 90 is manually controlled or controlled by the controller 110 to transfer the metal concentrate from the metal concentrate reservoir 190 to the gas dispersing portion 10. Then, the gas dispersing portion 10 is operated manually or through a control by the controller 110 to disperse a gas into the metal concentrate. In one example, the gas dispersing portion 10 is operated to disperse oxygen into a copper concentrate to prevent the formation of Cu(I) or oxidize Cu(I) to Cu(II) to thereby control the concentration of Cu(I) in the copper concentrate. In another example, the gas dispersing portion 10 is operated to disperse an inert gas such as nitrogen into a tin concentrate to displace gaseous oxygen in the tin concentrate to prevent the oxidation of Sn(II) to SN(IV) to thereby control or suppress the formation of Sn(IV).

Next, the circulation mechanism 90 is manually controlled or controlled by the controller 110 to transfer the electroplating solution from the gas dispersing portion 10 to the filter portion 50. In an example, the filter portion 50 is operated to pass tin concentrate through the surface area of the tin mesh whereby Sn(IV) reacts with the unoxidized tin to form and recover Sn(II).

Next, the circulation mechanism 90 is manually controlled or controlled by the controller 110 to transfer the metal concentrate or a sample of the metal concentrate to the analysis system 170. Then the analysis system 170 is operated to analyze the one or more aspects of the metal concentrate.

Next, the circulation mechanism 90 is manually controlled or controlled by the controller 110 to divert the metal concentrate to one of the electroplating tool 130 or to one or more of the metal concentrate reservoir 190, the gas dispersing portion 10, the filter portion 50, and the mesh portion 30, based on the results of the one or more analysis performed by the analysis system 170. In one example, when the one or more analysis performed by the analysis system 170 indicates a satisfactory result, the circulation mechanism 90 is manually controlled or controlled by the controller 110 to divert the metal concentrate to the electroplating tool 130. In another example, when the one or more analysis performed by the analysis system 170 indicates a satisfactory result, the circulation mechanism 90 is controlled by the controller to diver the metal concentrate back to the metal concentrate reservoir 190 for storage. In another example, when the one or more analysis performed by the analysis system 170 indicates an unsatisfactory result, the circulation mechanism 90 can be manually controlled or controlled by the controller 110 to divert the metal concentrate to one or more of the gas dispersing portion 10, the filter portion 50, and the mesh portion 30 for repeated treatment.

While the invention has been particularly shown and described with respect to preferred embodiments thereof, it will be understood by those skilled in the art that the foregoing and other changes in form and details may be made therein without departing from the spirit and scope of the present invention.

What is claimed is:

1. A system for treating a solution for use in an electroplating application, the system comprising:

a gas dispersing portion configured to treat the solution by dispersing a gas into the solution to control a concentration of a predetermined cation of a metal to be electroplated in the electroplating application, wherein the solution flows into the gas dispersing portion through a first inlet of the gas dispersing portion and out of the gas dispersing portion through an outlet of the gas dispersing portion;

a filter portion configured to treat the solution by filtering the solution to remove a quantity of a metal residue, wherein the filter portion is provided downstream of the gas dispersing portion in the flow direction of the solution and in direct fluid communication with the outlet of the gas dispersing portion;

a circulation mechanism configured to divert the solution to one of a plating tool and a combination of the gas dispersing portion and the filter portion based on a result of an analysis of the solution, wherein the circulation mechanism is provided downstream of the filter portion in the flow direction of the solution; and an analysis device configured to perform the analysis of the solution, wherein the analysis device is provided downstream of the filter portion and upstream of the circulation mechanism in the flow direction of the solution.

2. The system according to claim 1, wherein the metal to be electroplated in the electroplating application is copper (Cu), and wherein the gas dispersing portion is configured to treat the solution by dispersing oxygen into the solution to oxidize Cu(I) to Cu(II) to control a concentration of Cu(I) in the solution.

3. The system according to claim 2, wherein the circulation mechanism is configured to divert the solution to the plating tool based on a first result of the analysis of the solution, the first result indicating that the concentration of Cu(I) is at or below a predetermined concentration, and wherein the circulation mechanism is configured to divert the solution to the combination of the gas dispersing portion and the filter portion for treatment based on a second result of the analysis of the solution, the second result indicating that the concentration of Cu(I) is above the predetermined concentration.

4. The system according to claim 1, wherein the metal to be electroplated in the electroplating application is tin (Sn), and wherein the gas dispersing portion is configured to treat the solution by dispersing an inert gas into the solution to displace oxygen that is dissolved or dispersed in the solution to prevent the oxidation of Sn(II) to Sn(IV) to control the concentration of Sn(IV) in the solution.

5. The system according to claim 4, wherein the circulation mechanism is configured to divert the solution to the plating tool based on a first result of the analysis of the solution, the first result indicating that the concentration of Sn(IV) is at or below a predetermined concentration, and wherein the circulation mechanism is configured to divert the solution to the combination of the gas dispersing portion and the filter portion for treatment based on a second result of the analysis of the solution, the second result indicating that the concentration of Sn(IV) is above the predetermined concentration.

6. The system according to claim 4, wherein the filter portion is configured to treat the solution by filtering the solution to remove a quantity of Sn(IV) oxide.

7. The system according to claim 4, further comprising a mesh portion of unoxidized tin, wherein the mesh portion has a high surface area through which the solution is passed such that the Sn(IV) reacts with the unoxidized tin to form Sn(II).

8. The system according to claim 1, wherein the gas dispersing portion comprises:

a reservoir configured to hold the solution; and a disperser configured to disperse the gas from a gas source into the solution held in the reservoir.

9. The system according to claim 8, wherein the gas dispersing portion further comprises a heat injector configured to heat the solution prior to, during, or both the dispersing of the gas into the solution.

10. The system according to claim 8, further comprising a degasser configured to remove a quantity of gas bubbles dispersed in the solution by the disperser.

11. The system according to claim 1, wherein the solution is an electroplating solution used in the electroplating application in the plating tool, wherein the electroplating solution comprises an organic additive, and wherein the system further comprises a carbon treatment portion for removing a quantity of the organic additives from the electroplating solution.

12. The system of claim 1, further comprising a metal concentration reservoir provided downstream of the circulation mechanism and upstream of the gas dispersing portion in the flow direction of the solution, wherein the metal concentration reservoir is configured to receive and hold a metal concentrate of the solution, and wherein the gas dispersing portion further comprises a second inlet, and the metal concentration reservoir is in direct fluid communication with the second inlet of the gas dispersing portion.

13. A plating apparatus comprising:

the system according to claim 1; and the plating tool.

14. The system according to claim 1, wherein the solution for use in the electroplating application is a metal concentrate.

15. The system according to claim 1, further comprising a controller configured to:

receive the result of the analysis of the solution, and control the circulation mechanism to divert the solution to one of the plating tool and the combination of the gas dispersing portion and the filter portion based on the result of the analysis of the solution.

* * * * *